US005947201A

United States Patent [19]

Ross et al.

[11] Patent Number: 5,947,201

[45] Date of Patent: Sep. 7, 1999

[54] ONE-TRIP WINDOW-MILLING METHOD

[75] Inventors: Robert C. Ross, Nemachar; Brian C. Wood, Tornaveen; Clarence Vaughn Griffin, III, Castleton, all of United Kingdom

[73] Assignee: Baker Hughes Incorporated, Houston, Tex.

[21] Appl. No.: 08/597,311

[22] Filed: Feb. 6, 1996

[51] Int. Cl.[6] ..... E21B 29/06

[52] U.S. Cl. ..... 166/298; 166/117.6

[58] Field of Search ..... 166/298, 117.6, 166/117.5, 50; 175/61, 79–82

[56] References Cited

U.S. PATENT DOCUMENTS

| | | | |
|---|---|---|---|
| 3,908,759 | 9/1975 | Cagle et al. . | |
| 4,153,109 | 5/1979 | Szescila . | |
| 4,285,399 | 8/1981 | Holland et al. . | |
| 4,304,299 | 12/1981 | Holland et al. . | |
| 4,307,780 | 12/1981 | Curington . | |
| 4,397,355 | 8/1983 | McLamore | 166/297 |
| 4,765,404 | 8/1988 | Bailey et al. | 166/117.6 |
| 5,012,877 | 5/1991 | Winters et al. . | |
| 5,109,924 | 5/1992 | Jurgens et al. | 166/117.6 |
| 5,154,231 | 10/1992 | Bailey et al. . | |
| 5,193,620 | 3/1993 | Braddick | 166/382 |
| 5,195,591 | 3/1993 | Blount et al. . | |
| 5,277,251 | 1/1994 | Blount et al. . | |
| 5,287,921 | 2/1994 | Blount et al. . | |
| 5,335,737 | 8/1994 | Baugh . | |
| 5,341,873 | 8/1994 | Carter et al. . | |
| 5,398,754 | 3/1995 | Dinhoble . | |
| 5,409,060 | 4/1995 | Carter . | |
| 5,425,417 | 6/1995 | Carter . | |
| 5,427,179 | 6/1995 | Bailey et al. . | |
| 5,429,187 | 7/1995 | Beagrie | 166/117.5 |
| 5,431,219 | 7/1995 | Leising et al. . | |
| 5,431,220 | 7/1995 | Lennon et al. | 116/55.7 |
| 5,437,340 | 8/1995 | Lee et al. . | |
| 5,443,129 | 8/1995 | Bailey et al. | 175/45 |
| 5,445,222 | 8/1995 | Pritchard et al. . | |
| 5,488,989 | 2/1996 | Leising et al. | 166/117.6 |
| 5,592,991 | 1/1997 | Lembcke et al. | 166/117.6 X |

FOREIGN PATENT DOCUMENTS

| | | |
|---|---|---|
| 3832715 | 3/1990 | Germany . |
| 2258479 | 2/1993 | United Kingdom . |
| 2291448 | 1/1996 | United Kingdom . |
| WO 94/09243 | 4/1994 | WIPO . |
| WO 95/23274 | 8/1995 | WIPO . |

OTHER PUBLICATIONS

Baker Oil Tools, Permanent Packer Systems, Model "D" and "DB" Retainer Production Packer, date unknown.

Baker Oil Tools, Permanent Packer Systems, Electric Wireline Packer Setting, Model "E–4" Wireline Pressure Setting Assembly, Model "L" Hi–Temp Wireline Pressure Setting Assembly, date unknown.

Baker Oil Tools, Permanent Packer Systems, Model "BH" Setting Tools, Model "BHH" Setting Tool date unknown.

Baker Oil Tools, Permanent Packer Systems, Model "DW–1" Whipstock Packer, Model "W–2" Whipstock Anchor Assembly, date unknown.

(List continued on next page.)

*Primary Examiner*—Hoang C. Dang
*Attorney, Agent, or Firm*—Rosenblatt & Redano P.C.

[57] ABSTRACT

A one-trip whipstock milling system is disclosed which allows for setting of a packer or plug which is run in as part of the bottomhole assembly, in conjunction with orientation instrumentation, a whipstock, and a one-trip milling system connected to the whipstock. The assembly is run-in the hole together and inserted to the desired depth. With the orientation of the whipstock known from the down-hole instrumentation, the preferred embodiment involves pressurization of the wellbore to actuate the packer assembly. Having set the packer at the proper orientation and depth, the milling immediately begins and continues in a continuous effort until the window is fully milled, at which point the milling equipment and orientation equipment are withdrawn from the wellbore.

19 Claims, 10 Drawing Sheets

OTHER PUBLICATIONS

Baker Hughes Inteq. Seeker Surveying System, Technical Data Sheet, date unknown.
Computalog, Wireline Products Catalog, 1991–1992.
Baker Oil Tools, Production Report, Window Master, 3 pages, 1995.
Hart's Petroleum Engineer International, p. 13, 1997.
Baker Hughes Inteq. Leaders in Drilling Solutions information brochure, 1997.

A–Z International Casing Sidetrack Systems, Catalog, A–Z/Grant International, 7 pages, date unknown.

The Red Baron Whipstock, Single Trip Side Track System Technical Specifications, 6 pages, date unknown.

ONE-TRIP WINDOW-MILLING METHOD

FIELD OF THE INVENTION

The field of this invention relates to one-trip whipstock packer systems.

BACKGROUND OF THE INVENTION

One of the valuable commodities for a well operator is time. The faster downhole operations can be accomplished, the more the operator saves. Prior procedures for milling a window in a casing have involved the placement, orientation, and securing of a whipstock. In the past this has involved many steps. Traditionally, a packer was run in the hole and set. This packer had an anchor slot for a whipstock anchor. After the packer was set, measurement of the orientation of its anchor slot had to be determined, generally in a separate trip into the well. Having determined the orientation of the anchor receptacle in the packer, the whipstock was run-in with generally a starter mill and secured to the packer. Once the whipstock was secured, the starter mill would be engaged to start the milling of the window. The starter mill would then be removed from the wellbore and a window mill inserted on a different trip to complete the cutting out of the window in the casing.

Subsequently, a one-trip milling system for a window was developed and is fully described in the Jurgens U.S. Pat. No. 5,109,924. This system eliminated an extra trip to replace the starter mill with a window mill. The combination of mills preassembled to a whipstock, as illustrated in the Jurgens patent, allowed the milling of the window from start to finish after the whipstock was properly oriented and supported.

Prior designs have attempted to combine the packer and whipstock for insertion into the wellbore in a single trip. These have generally involved hydraulically set packers that have required the use of jumper hoses around the whipstock to access the packer. These prior techniques of combining the packer and whipstock, using fluids diverted through the bottomhole assembly, had various mechanical and operational difficulties, generally involving difficulty in running the assembly into the well and reliability of the assembly once the proper depth was reached. One example of this technique is the A–Z International Casing Sidetrack System. This system has generally been used with a starter mill, which still necessitated an extra trip for switching out the starter mill to a window mill.

Thus, an objective of this invention is to provide for a truly one-trip system that allows the proper placement and orientation of a whipstock and packer assembly, coupled with a design which is simple and reliable to use and operate. The overall bottomhole assembly, using the technique of the Jurgens patent, is truly a one-trip system in that the whole bottomhole assembly is run in the wellbore, followed by setting the packer where it secures the whipstock support, followed by drilling the entire window, all without coming out of the hole a single time.

Other advantages are to create a positive barrier downhole to meet with normal offshore safety procedures by providing a packer design to go with the whipstock which will reliably give such positive sealing. Another objective is to design the packer to actuate off of applied pressure in the wellbore so as to permit the use of a large piston to ensure a good packoff and to take advantage of hydrostatic pressures to continually boost the sealing pressure on the packer assembly. Another object is to make the design simple enough for it to be function-checked at the surface before being run in the hole. Those and other advantages will become more apparent from a review of the description of the preferred embodiment.

SUMMARY OF THE INVENTION

A one-trip whipstock milling system is disclosed which allows for setting of a packer or plug which is run in as part of the bottomhole assembly, in conjunction with orientation instrumentation, a whipstock, and a one-trip milling system connected to the whipstock. The assembly is run-in the hole together and inserted to the desired depth. With the orientation of the whipstock known from the down-hole instrumentation, the preferred embodiment involves pressurization of the wellbore to actuate the packer assembly. Having set the packer at the proper orientation and depth, the milling immediately begins and continues in a continuous effort until the window is fully milled, at which point the milling equipment and orientation equipment are withdrawn from the wellbore.

DETAILED DESCRIPTION OF THE PREFERRED EMBODIMENT

Figure 8:
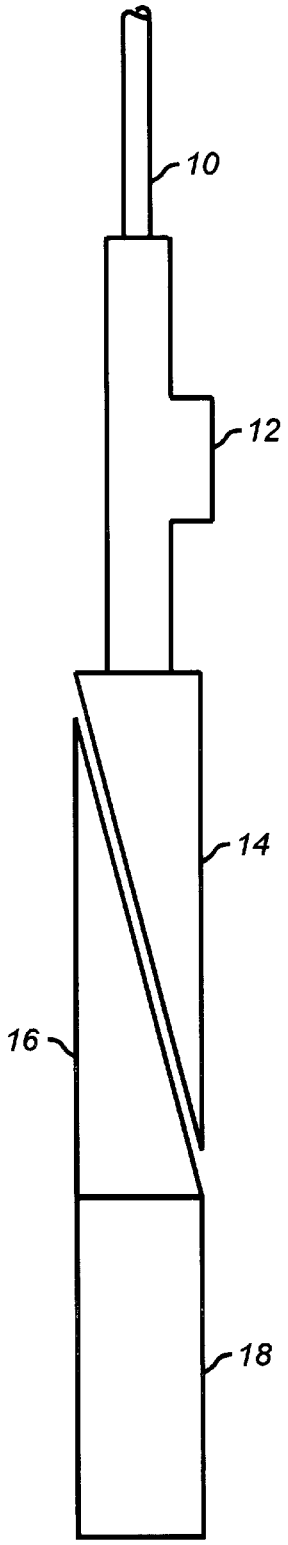
FIG. 8 is a schematic illustration of the bottomhole assembly employing the present invention.
Figure 9A:
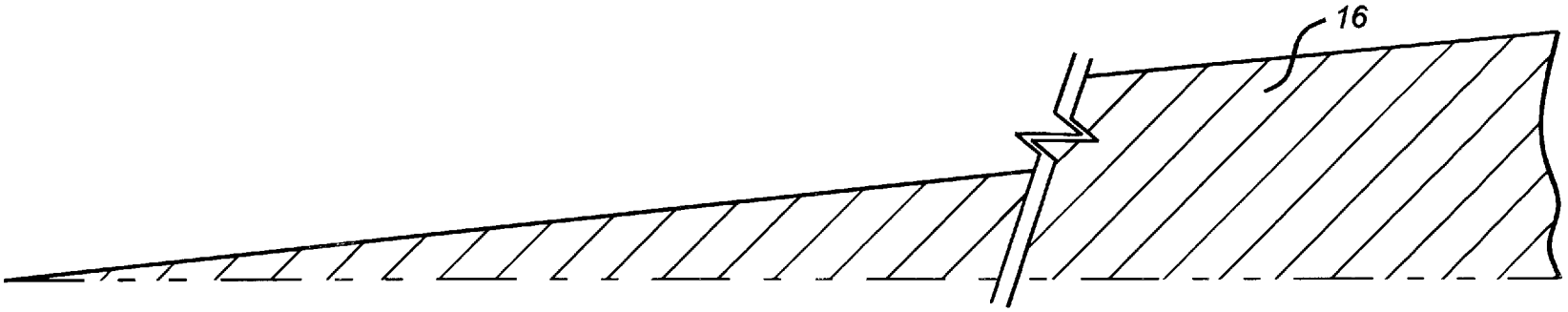
FIGS. 9*a–d* are a sectional elevational view of an alternative embodiment indicating a shear screw release mechanism, as well as use of shear screws to hold the tool in its initial position prior to set by applied fluid pressure in the wellbore.
Figure 9B:
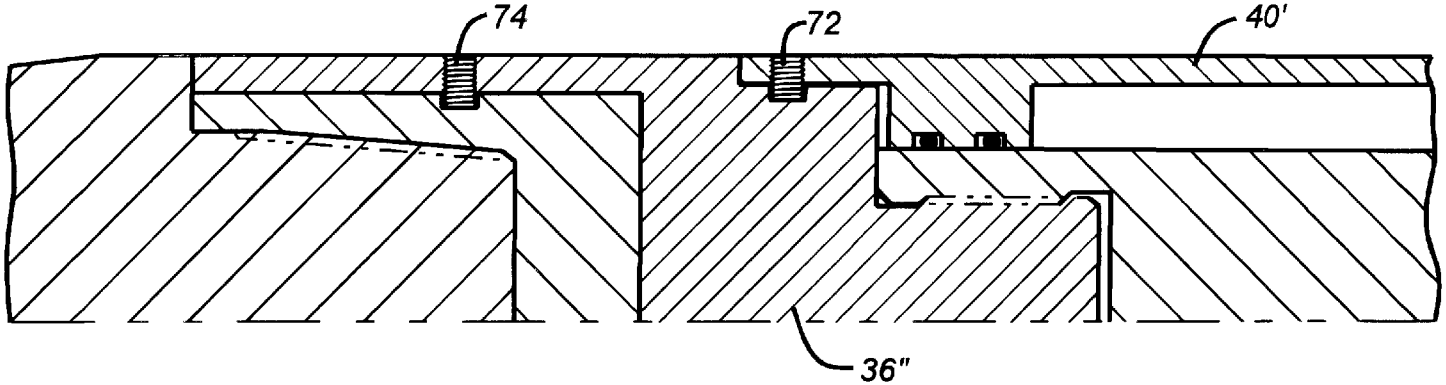
Figure 9C:
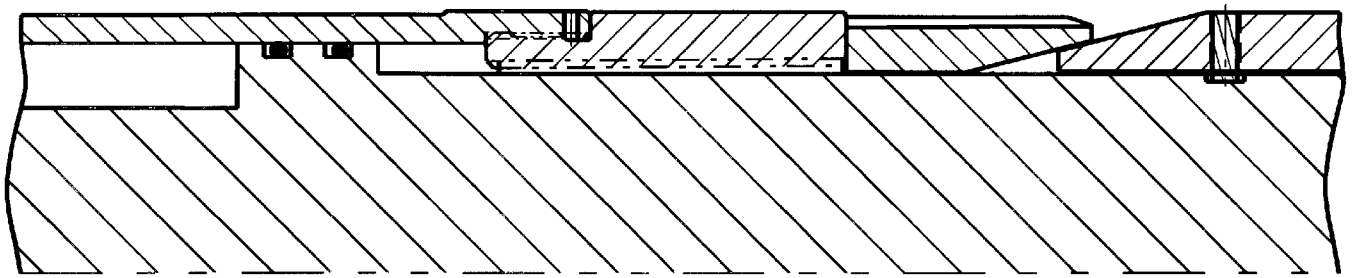
Figure 9D:
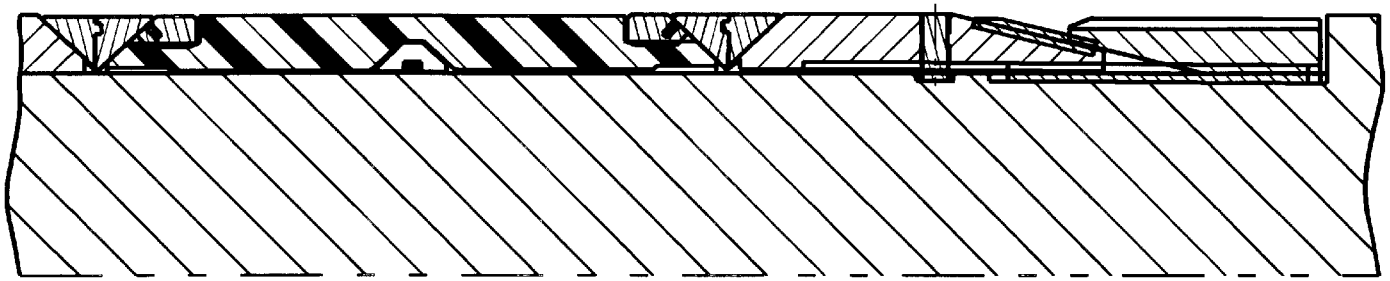

The preferred arrangement of the bottomhole assembly illustrated in FIG. 8. Suspending the bottomhole assembly is a tubing string 10 which can be rigid or coiled tubing. A known orientation device 12, such as the Seeker model offered by Baker Hughes Inteq or others, is attached to the tubing string 10. The orientation device 12 can also be run through the tubing string 10 on wireline as an alternative. In that event, it is run in separately from the bottomhole assembly and after milling is withdrawn separately. Below the orientation device 12 is a series of mills for a one-trip window-milling system, generally referred to as 14, which can be of the type illustrated in the Jurgens U.S. Pat. No. 5,109,924. If coiled tubing is used, a downhole motor can be employed directly above the window-milling system 14. Below the one-trip milling system 14 is the whipstock 16, coupled to the packer or other support 18. "Packer" is intended to encompass all types of whipstock supports, including but not limited to packers, plugs, or anchors. The other figures in the application illustrate details of the packer or other support 18 with the whipstock 16 attached to its upper end.

FIGS. 1–6 illustrate the rotational locking system as between the packer body 20 and the cone 22, as well as between the cone 22 and the slip 24.

Figure 1:
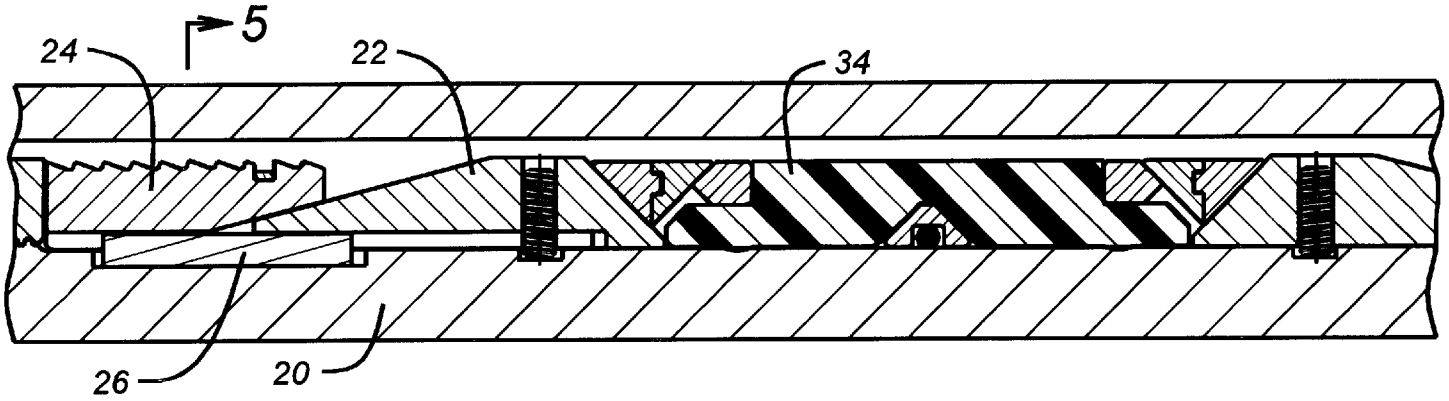
FIG. 1 is a sectional elevational view of the slips and sealing element of the packer portion of the preferred embodiment, showing the torque key between the body and the cone.
Figure 2:
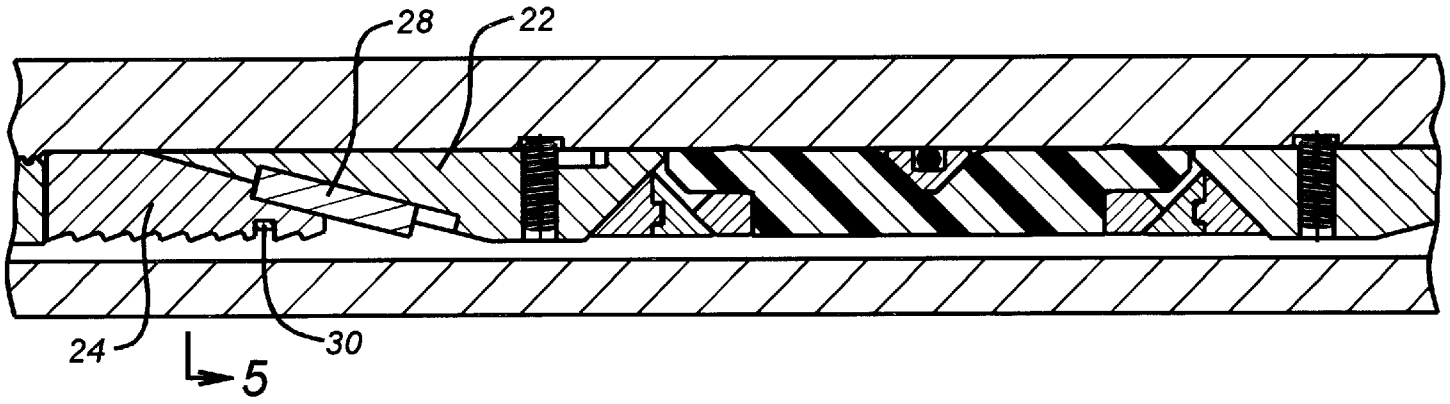
FIG. 2 is a rotated view of FIG. 1, showing the torque key between the cone and the slip.
Figure 3:
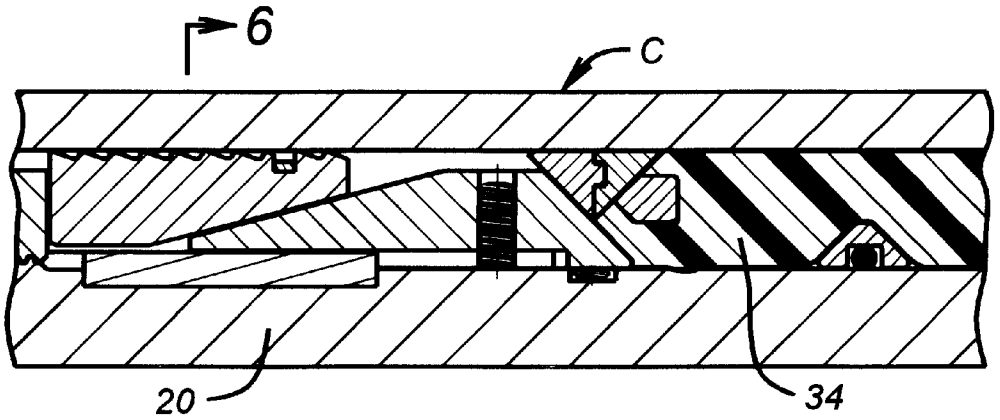
FIGS. 3 and 4 are counterparts to FIGS. 1 and 2, respectively, except that the packer or plug is shown in the set position as opposed to the run-in position.
Figure 4:
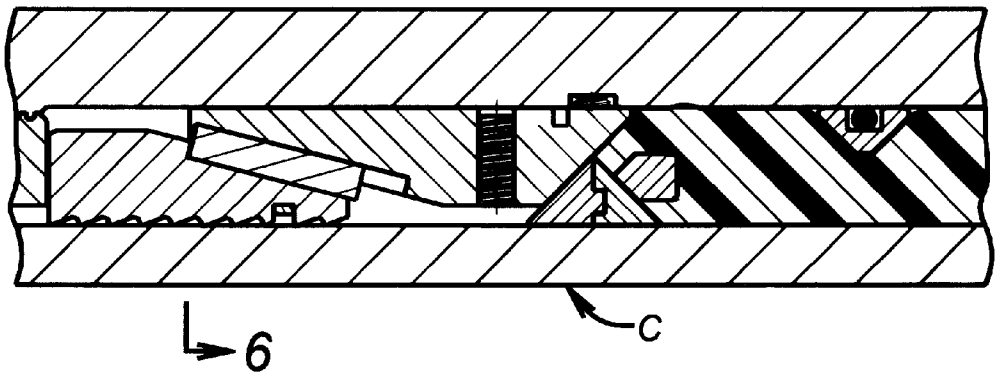
Figure 5:
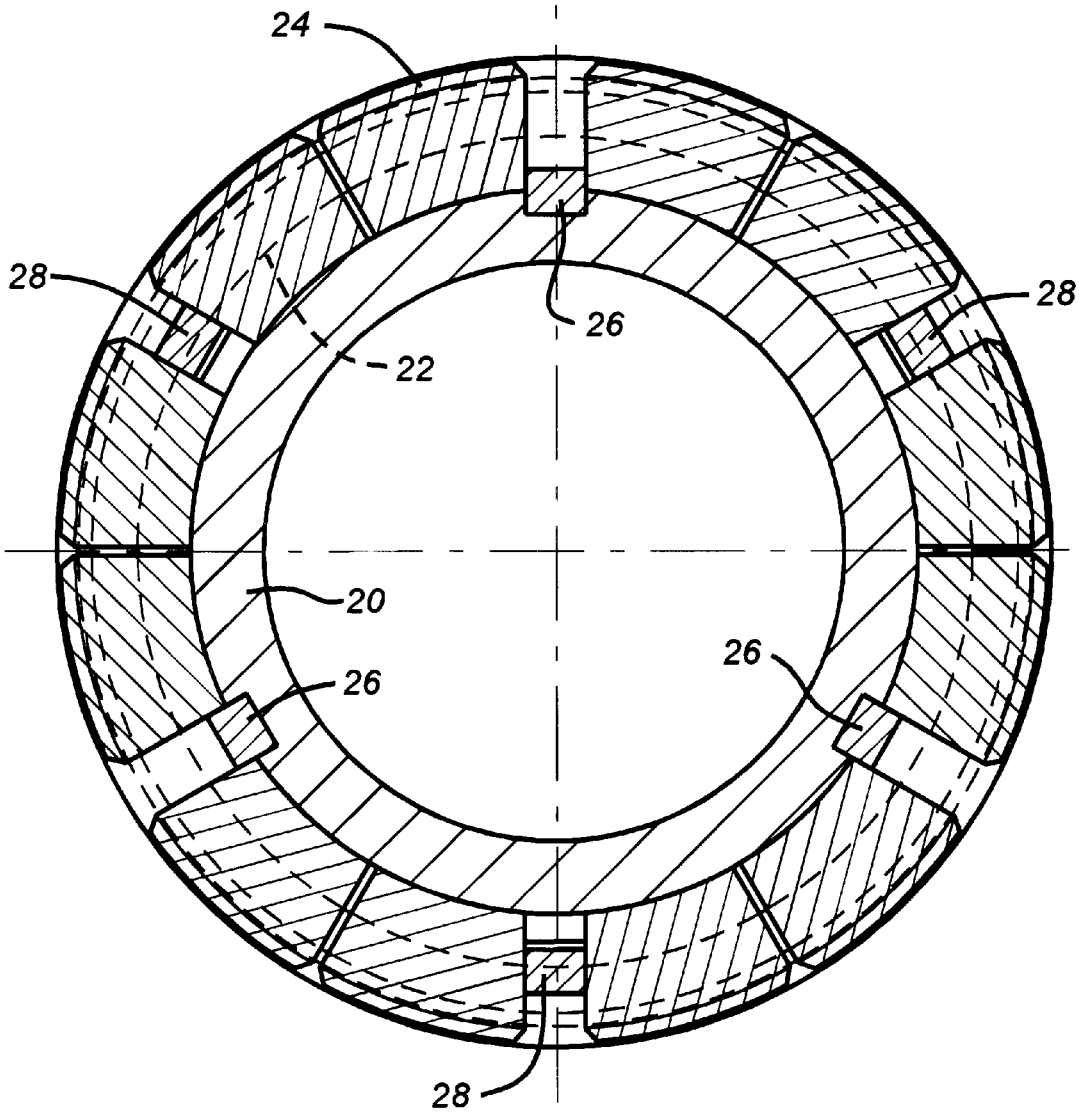
FIG. 5 is a section view along line 5—5 of FIGS. 1 and 2.
Figure 6:
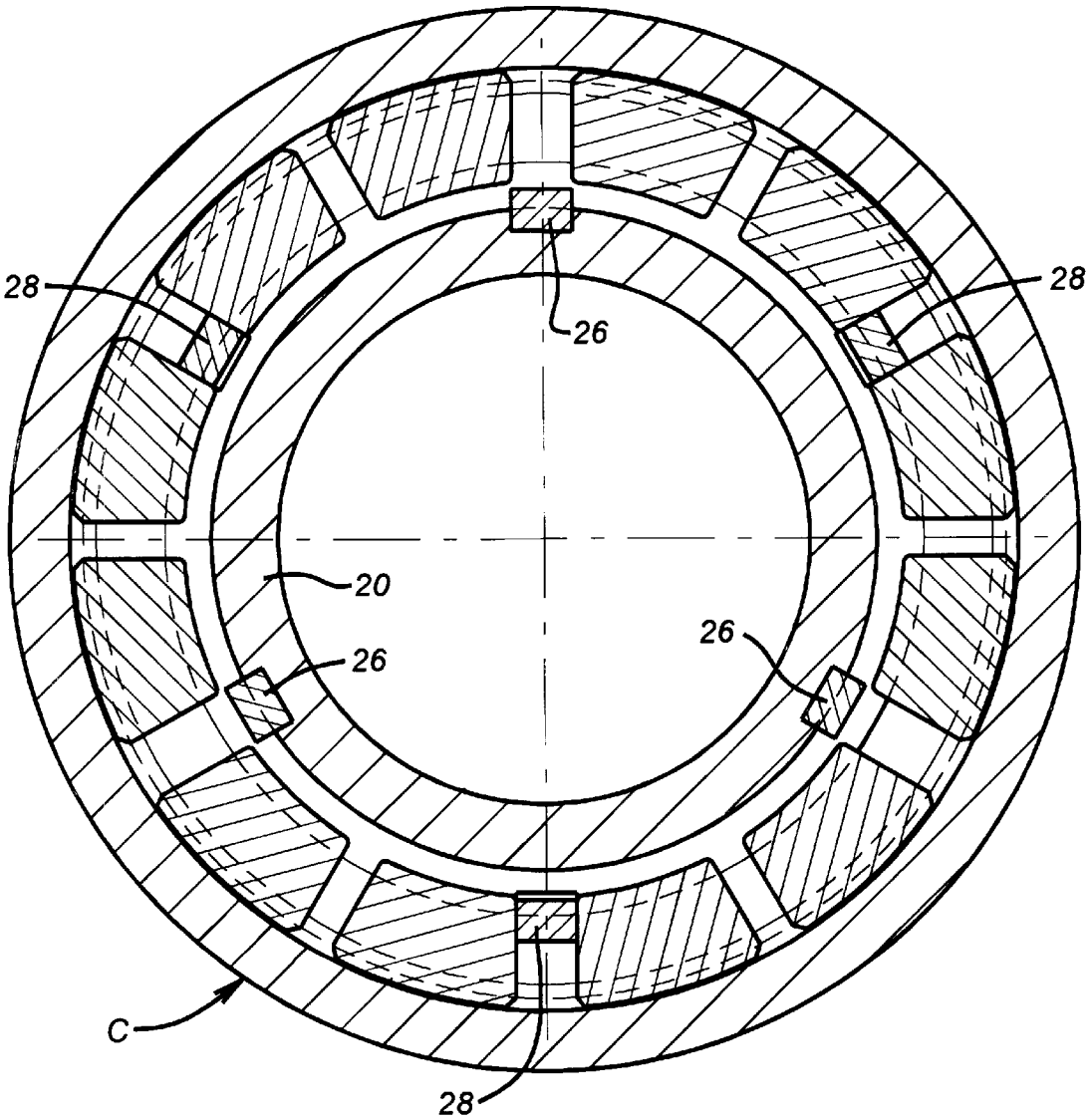
FIG. 6 is a section view along lines 6—6 of FIGS. 3 and 4.

The run-in position is shown in FIGS. 1 and 2. In FIG. 1, a key 26 rotationally locks the packer body 20 to the cone 22. FIG. 2 is a rotated view of FIG. 1 and shows the key 28 as a rotational lock between the cone 22 and the slips 24. The run-in position in cross-section is shown in FIG. 5. In the section view of FIG. 5, the cone 22 is a hidden line, with the keys 28 illustrating the rotational lock between the cone 22 and the slips 24.

Referring back to FIGS. 1 and 2, the slips 24 are restrained by a band 30, which gives way as the slips 24 ride up the cone 22. Those skilled in the art will appreciate that while, in this particular case the upper slip operation has been described, the lower slip operation is identical. The lower slips 32 are illustrated in position in FIG. 7*c* and are disposed on the other side of the sealing element system 34, as shown in FIG. 1 in the retracted position and in FIG. 3 in the expanded position. The precise layout of the sealing element system 34 is of a type that is known in the art and, therefore, will not be explained in detail in the application.

Referring again to FIG. 6, the section view in the expanded position is illustrated to show the operation of the rotational locks provided by the keys 26 and 28. Rotational forces can be transmitted to the slips 24 when the one-trip window-milling system 14 (see FIG. 8) makes an occasional contact with the whipstock 16 during the milling operation. Since the milling system is rotating, any contact with the whipstock's tapered face results in a turning moment applied to the body 20, which is then transmitted through the key 26 to the cone 22, and in turn through key 28 to the slips 24, thus greatly enhancing the ability of the packer or other support 18 to withstand applied torques and remain in contact with a casing or liner C in the position shown in FIGS. 3 and 4. Note that the overlap of keys 26 and 28 increases in the set position so that they get a better grip to transfer torque to slips 24 or 32.

Referring now to FIG. 7, the components will be described to illustrate the operation of the packer 18 in one configuration that can be used in tandem with a whipstock 16. In general, the packer or plug 18, which is envisioned in the preferred embodiment, is settable by application of pressure to the wellbore from the surface after the proper depth and orientation have been achieved. The packer body 20 is made up of a top sub 36, which is connected to the body 20 and rotationally locked to it by a key or keys 38. A setting sleeve 40 fits over the top sub 36 to create a cavity 42. Cavity 42 is sealed by seals 44. Setting sleeve 40 is held in a fixed position to ring 44 by a shear ring 46. In the preferred embodiment, the shear ring is a slit ring with an L-shaped cross-section, one leg of which is inserted into a groove in ring 44; the other leg is in contact with ring 48, which is in turn secured to setting sleeve 40 at thread 50. The whipstock 16 is secured to top sub 36. The assembly shown in FIG. 8 is run from the surface and ultimately supports the top sub 36 so that when an increase in wellbore pressure applied from the surface, beyond a predetermined amount, causes stresses on the shear ring 46 beyond its ability to resist them, the setting sleeve 40 moves with respect to the top sub 36, which in turn reduces the volume of cavity 42. The relative movement between the top sub 36 and the setting sleeve 40 sets the sealing element system 32 as well as the slips 24 on the upper side and 32 on the lower side.

Figure 7A:
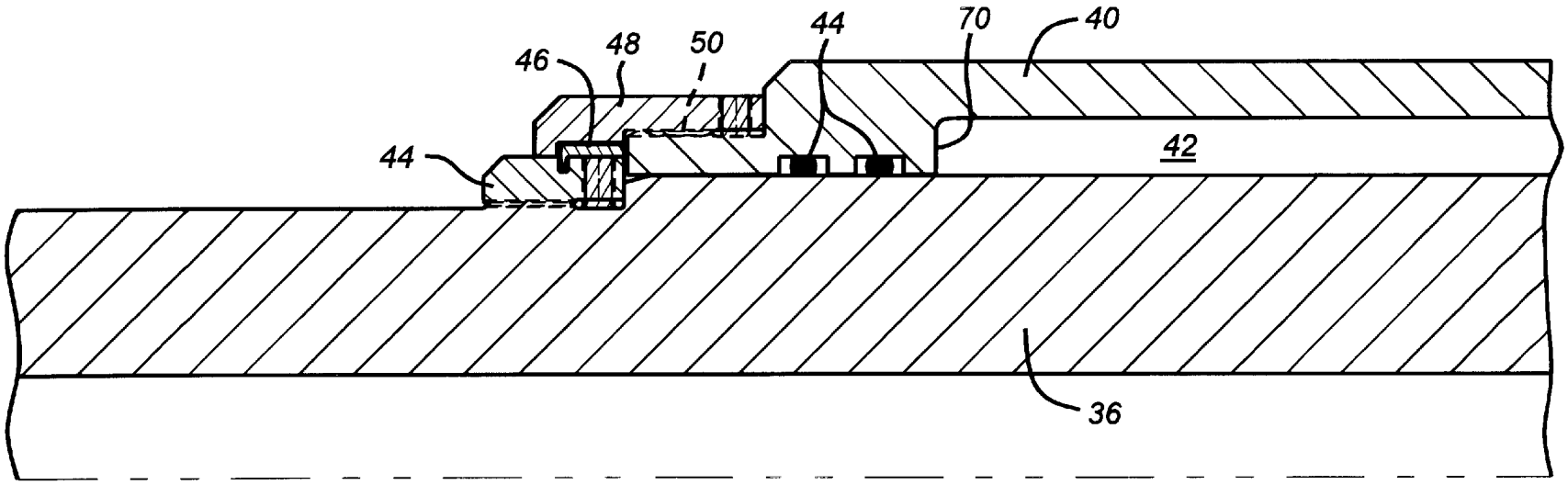
FIGS. 7*a–c* are a detailed elevational view of the setting and emergency release abilities as between the packer and the whipstock which is supported by the top sub.
Figure 7B:
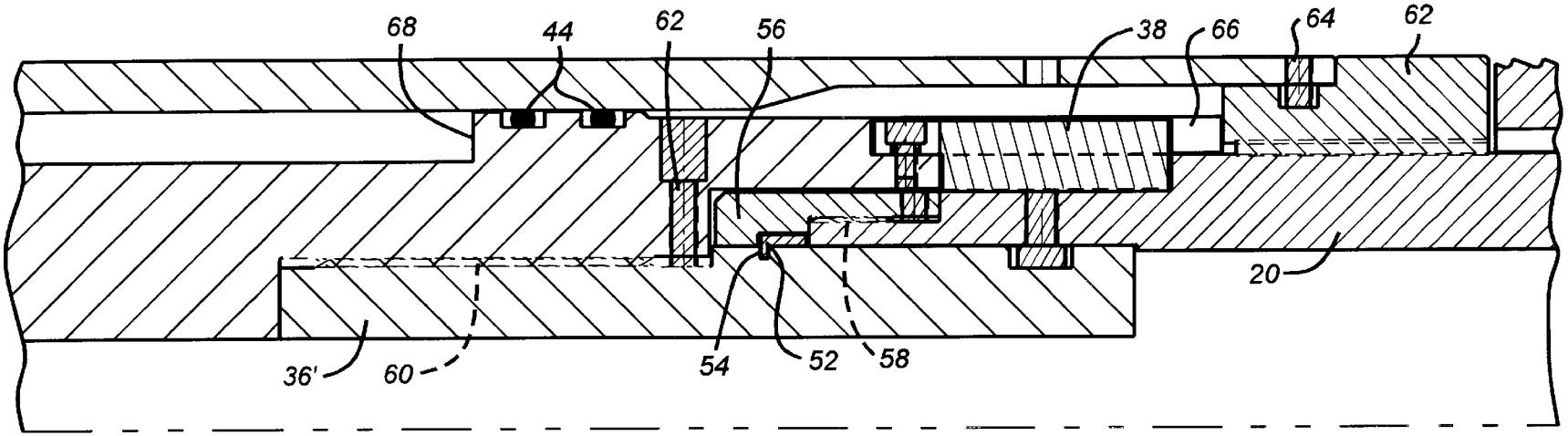

A release feature is also provided in the assembly shown in FIG. 7. This allows for disconnection between the top sub 36 and the body 20 in the event the packer assembly 18 actuates in the wrong location or in the wrong orientation. If this occurs, it is most desirable to remove as much as metal as possible from the wellbore to shorten the length of any milling that will have to go on when the packer 18, which is either at the wrong depth or in the wrong orientation, needs to be milled out. This type of release is accomplished by the use of another shear ring 52, which extends into top sub 36 at groove 54. The balance of the shear ring 52 extends into engagement with a shoulder on ring 56. Ring 56 is, in turn, threadedly secured to body 20 at thread 58. The top sub 36 has a bottom sleeve 36' connected to it at thread 60. Pin 62 secures the threaded connection at thread 60 between the top sub 36 and the bottom sleeve 36'. As shown in FIG. 7*b*, the setting sleeve 40 bears on lock ring 62, with a shear screw 64 securing the attachment. In the event the packer or plug 18 is actuated at an improper depth or in an improper orientation, an upward force on the string 10 is conveyed to the top sub 36 and bottom sleeve 36'. Since the top sub 36 is slotted near its bottom end 66, a force in excess of the ability of the shear ring 52 to hold such stress results in a separation between the bottom sleeve 36' and the body 20. The top sub 36 can move upwardly, leaving the key 38 behind. Ultimately, shoulder 68 contacts shoulder 70 within the cavity 42, thus bringing up the setting sleeve 40 after shear pin 64 breaks to allow release of the setting sleeve 40 from the lock ring 62. When all these actions occur, the bottomhole assembly illustrated in FIG. 8 can be removed from the wellbore down to the whipstock 16. What remains in the wellbore is the body 20, as well as the upper and lower slips 24 and 32, respectively, and the sealing element system 34 in between. This equipment will have to be milled out. However, the release feature greatly reduces the scope of the milling job since the whipstock 18 is removed prior to milling.

Figure 7C:
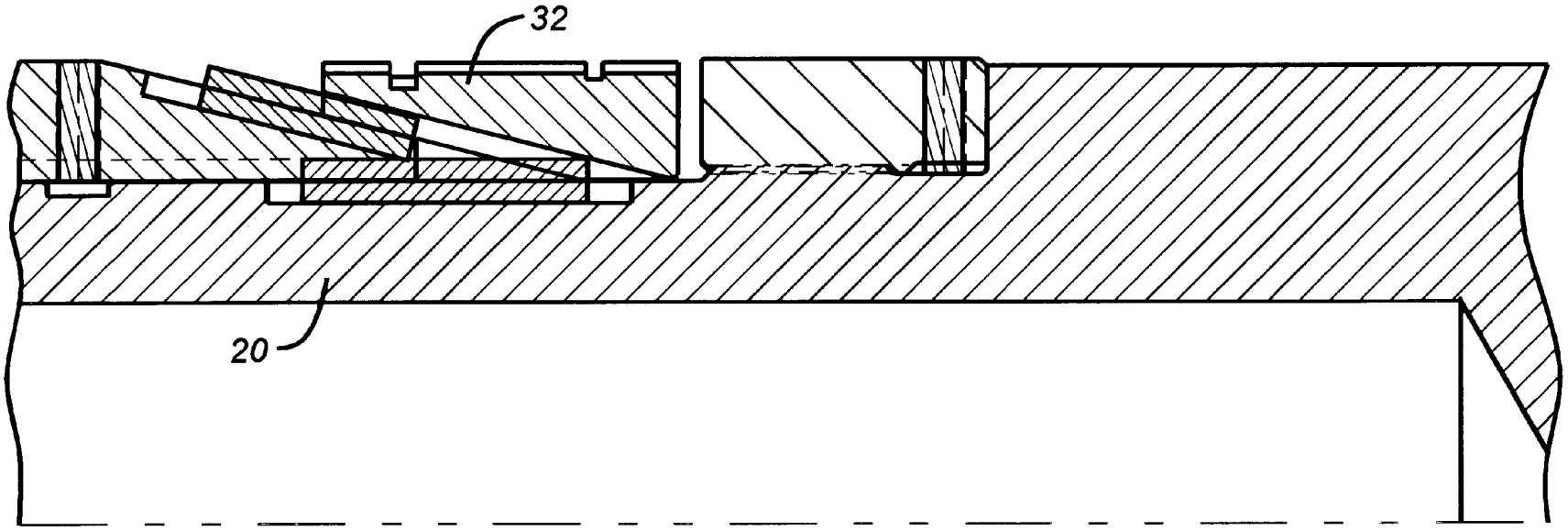

FIG. 9*a–d* illustrates an alternative embodiment to FIG. 7*a–c*. The operation is essentially the same, except that a shear screw or screws 72 are overcome upon application of fluid pressure in the wellbore, which provides a sufficient pressure imbalance on the setting sleeve 40' to actuate the setting motions described above with similar components. The release mechanism for the embodiment in FIGS. 9*a–d* is one or more shear screws 74, which retain the whipstock 16 to the top sub 36". In other respects, the operation of the embodiment illustrated in FIGS. 9*a–d* is the same as that in FIGS. 7*a–c*.

It should be noted that the bodies in the packer or plugs 18 are preferably solid, which allows the use of a large piston area to ensure a good packoff. The use of the keys 26 and 28 has been tested and found to resist torque in excess of about 10,000 ft/lb in a 9-⅝" casing. The setting mechanism for the packer or plug assembly 18 is simple but stout enough to withstand dirty well conditions and still function reliably. The use of the atmospheric chamber 42 also permits testing at the surface prior to running in the well to be sure that the O-rings or other seals 44 are sealing properly and have not been damaged during assembly. While the chamber 42 has been described as containing atmospheric pressure, those skilled in the art can appreciate that other pressures can be used without departing from the spirit of the invention. As previously described, if there is a premature set of the packer 18 or a set in the wrong orientation for whatever reason, a release is possible between the whipstock 16 and the packer assembly 18 to allow for milling and fishing by conventional methods. The use of sealing technology, comprising of the sealing element system 34 and the upper and lower slips 24 and 32, respectively, allows the assembly 18 to be considered as a true barrier for certain regulatory and procedural safeguards employed in the industry. Since hydrostatic pressure plus applied pressure are used to set the packer assembly 18, the available hydrostatic pressure in the well after setting helps to further ensure a boost force applied to the sealing element system 34 to ensure the integrity of the seal. The system as illustrated can be used in conjunction with a permanent bridge plug below and, therefore, give the two positive barriers to the formation in compliance with normal offshore safety procedures.

In operation, during run-in the string 10 can be oriented while the bottom-hole assembly illustrated in FIG. 8 is being run into the wellbore. Generally speaking, the proper orientation can be obtained on the trip down to the desired depth. Having stabilized the bottomhole assembly with the tubing string 10 at the desired depth, and having obtained the necessary readings from the orientation device 12, the actuation of the packer or plug 18 is initiated with additional pressure applied to the wellbore from the surface. Following the setting of the packer assembly 18, milling can begin immediately. If rigid tubing is used, the tubing is rotated from the surface. If coiled tubing is used as the string 10, a downhole motor may be used in conjunction with the coiled tubing 10 to provide the necessary rotational force to the one-trip window-milling system 14 so that the entire window can be milled in the casing to conclusion, followed by removal of the bottomhole assembly from the wellbore above the whipstock 16.

What is described above is truly a one-trip system that is mechanically reliable and eliminates the use of inconvenient and cumbersome jumper hoses that go around or through the whipstock to reach the packer for setting it. Instead, a system easily controlled from the surface is provided, along with a securing and sealing system for the packer 18, which assures a good set and seal, coupled with providing the option for an emergency release.

While the body 20 and top sub 36 have been illustrated as solid members, it is within the purview of the invention to provide a passage through those members so that, perhaps in subsequent operations, access through bodies 20 and 36 can be obtained for further production or downhole operations below the packer or plug 18 upon ultimate removal of the whipstock 16.

The foregoing disclosure and description of the invention are illustrative and explanatory thereof, and various changes in the size, shape and materials, as well as in the details of the illustrated construction, may be made without departing from the spirit of the invention.

We claim:

1. A method of milling a window in a casing in a single trip, comprising:

running a bottomhole assembly comprising whipstock support, a whipstock, a window-milling system, and an orientation tool to a desired depth;

using a packer as said whipstock support;

determining the desired whipstock orientation with said orientation tool;

setting said packer by pressurizing the wellbore; and milling the entire window in the casing or tubing, all without coming out of the well.

2. The method of claim 1, further comprising:

providing a piston on the body of said packer;

defining a low-pressure-containing, sealed variable-volume cavity between said piston and said packer body;

using said wellbore pressurizing to move said piston against said low pressure for setting said packer.

3. The method of claim 2, further comprising:

providing a frangible element to prevent initial movement of said piston due to hydrostatic forces;

breaking said frangible element with said wellbore pressurizing to initiate piston movement.

4. The method of claim 1, further comprising:

providing an emergency release between said whipstock and said whipstock support.

5. The method of claim 3, further comprising:

setting slips and a sealing element as a result of said piston movement.

6. The method of claim 5, further comprising:

providing a cone to move said slips outwardly.

7. The method of claim 6, further comprising:

rotationally locking said cone to said slips.

8. The method of claim 7, further comprising:

rotationally locking said cone to said packer body.

9. The method of claim 8, further comprising:

using keys in aligned slots as said rotational locks.

10. The method of claim 1, further comprising:

using slips to anchor said whipstock support;

moving said slips outwardly by using a cone;

rotationally locking said slips to said cone.

11. The method of claim 10, further comprising:

rotationally locking said cone to the body of said whipstock support.

12. The method of claim 11, further comprising:

providing an emergency release between said whipstock and said whipstock support.

13. The method of claim 12, further comprising:

providing a separable body on said whipstock support;

securing said separable body with a frangible member;

rotationally locking said separable body and whipstock support to each other.

14. The method of claim 4, further comprising:

providing a separable body on said whipstock support;

securing said separable body with a frangible member; rotationally locking said separable body and whipstock support to each other.

15. The method of claim 1, further comprising:

using a series of mills initially supported by said whipstock to mill the window;

retrieving said mills and said orientation tool after milling the window.

16. The method of claim 11, further comprising:

resisting in excess of 10,000 ft/lbs of torque applied to said slips due to said rotational locking.

17. The method of claim 1, further comprising:

running in said orientation tool on wireline through tubing supporting the bottomhole assembly.

18. The method of claim 1, further comprising:

running in the orientation tool as an integral part of the bottomhole assembly;

retrieving said orientation tool with said milling system as a unit after the window milling is complete.

19. The method of claim 17, further comprising:

retrieving said orientation tool separately from said milling system after the window milling is complete.

* * * * *